US011686121B2

(12) United States Patent
Furseth et al.

(10) Patent No.: US 11,686,121 B2
(45) Date of Patent: Jun. 27, 2023

(54) PORTABLE SHELTERS

(71) Applicant: ARDISAM, INC., Cumberland, WI (US)

(72) Inventors: Michael Furseth, Cumberland, WI (US); Chuck Librande, Rice Lake, WI (US); Scott Nickell, Cumberland, WI (US)

(73) Assignee: ARDISAM, INC., Cumberland, WI (US)

( * ) Notice: Subject to any disclaimer, the term of this patent is extended or adjusted under 35 U.S.C. 154(b) by 15 days.

(21) Appl. No.: 16/946,415

(22) Filed: Jun. 19, 2020

(65) Prior Publication Data

US 2021/0396037 A1 Dec. 23, 2021

(51) Int. Cl.

| | |
|---|---|
| ***E04H 15/46*** | (2006.01) |
| ***E04H 15/60*** | (2006.01) |
| *A45B 23/00* | (2006.01) |

(52) U.S. Cl.

CPC ..... *E04H 15/46* (2013.01); *E04H 15/60* (2013.01); *A45B 23/00* (2013.01); *A45B 2023/0012* (2013.01)

(58) Field of Classification Search

CPC ..... E04H 15/60

See application file for complete search history.

(56) References Cited

U.S. PATENT DOCUMENTS

| | | | | |
|---|---|---|---|---|
| 1,502,898 A | 7/1924 | Berg | | |
| 2,953,145 A | 9/1960 | Moss et al. | | |
| 3,266,503 A * | 8/1966 | Hoiness | E04H 15/48 | 135/153 |
| 3,327,723 A | 6/1967 | Burgin | | |

(Continued)

FOREIGN PATENT DOCUMENTS

| | | |
|---|---|---|
| CN | 102535945 A | 7/2012 |
| CN | 211691769 U | 10/2020 |
| KR | 20090045701 A | 5/2009 |

OTHER PUBLICATIONS

Barronett Blinds, "How to Set-up and Take-down a Hub Blind from Barronett Blinds," YouTube, URL: https://www.youtube.com/watch?v=gEO1EBG5EQg, Jul. 18, 2013.

(Continued)

*Primary Examiner* — David R Dunn
*Assistant Examiner* — Danielle Jackson
(74) *Attorney, Agent, or Firm* — Perkins Coie LLP

(57) ABSTRACT

A portable shelter includes a frame structure with a plurality of pole structures. In some embodiments, a pole structure includes telescopically movable pole portions and a spring-biasing mechanism configured to bias one pole portion away from the other. In some embodiments, a center hub structure of the portable shelter includes a locking mechanism for engaging one of the pole portions to interfere with telescopic movement of the pole structure. In some embodiments, a pole structure includes a flexible portion attached to a first rigid portion, and a second rigid portion that is movable relative to the first rigid portion. The second rigid portion is pivotable or telescopically movable between a first position in which the second rigid portion overlaps the first rigid portion such that the flexible portion is free to flex, and a second position in which the second rigid portion overlaps and restrains the flexible portion.

12 Claims, 14 Drawing Sheets

(56) References Cited

U.S. PATENT DOCUMENTS

| | | | | |
|---|---|---|---|---|
| 3,865,123 | A | 2/1975 | Bracken | |
| 4,066,089 | A * | 1/1978 | Rainwater | E04H 15/48 135/117 |
| 4,239,247 | A | 12/1980 | Hinz | |
| 4,585,020 | A | 4/1986 | Masuda et al. | |
| 4,938,243 | A * | 7/1990 | Foster | E04H 15/48 135/901 |
| 5,046,882 | A | 9/1991 | Ju | |
| 5,271,423 | A | 12/1993 | Eychaner | |
| 5,749,387 | A * | 5/1998 | Thompson | E04H 15/001 135/901 |
| 6,089,247 | A * | 7/2000 | Price | E04H 15/48 135/145 |
| 6,216,717 | B1 * | 4/2001 | Chen | E04H 15/44 135/130 |
| 6,666,223 | B2 * | 12/2003 | Price | E04H 15/50 135/147 |
| 6,776,179 | B1 | 8/2004 | Chen | |
| 6,868,858 | B2 * | 3/2005 | Suh | E04H 15/48 135/145 |
| 7,168,439 | B2 * | 1/2007 | Patel | E04H 15/50 135/145 |
| 7,357,140 | B2 * | 4/2008 | Chu | E04H 15/48 135/144 |
| 7,607,447 | B1 | 10/2009 | Han | |
| 7,640,942 | B2 | 1/2010 | Chu | |
| 7,703,469 | B2 | 4/2010 | Danziger | |
| 7,845,364 | B2 | 12/2010 | Tolmie | |
| 8,056,573 | B2 | 11/2011 | Panigot | |
| 8,079,380 | B2 | 12/2011 | Engstrom et al. | |
| 8,746,179 | B2 * | 6/2014 | Farmer | A01K 1/0254 119/474 |
| 8,776,816 | B2 | 7/2014 | Danziger | |
| 9,340,992 | B2 | 5/2016 | Huang | |
| 9,506,269 | B2 | 11/2016 | Armstrong et al. | |
| 9,644,387 | B2 | 5/2017 | Makos et al. | |
| 10,058,181 | B2 | 8/2018 | Makos | |
| 10,612,265 | B1 | 4/2020 | Walter | |
| 10,676,955 | B1 | 6/2020 | Tufto et al. | |
| 2006/0238005 | A1 | 10/2006 | Walter et al. | |
| 2007/0051399 | A1 | 3/2007 | Jung | |
| 2010/0126546 | A1 | 5/2010 | Chen | |
| 2012/0186619 | A1 | 7/2012 | Makos | |
| 2013/0008478 | A1 | 1/2013 | Prieto Estebanez | |
| 2014/0109945 | A1 | 4/2014 | Jin | |
| 2014/0130837 | A1 | 5/2014 | Sy-facunda | |
| 2014/0202509 | A1 | 7/2014 | Schamberger et al. | |
| 2016/0010357 | A1 | 1/2016 | Makos et al. | |
| 2017/0339941 | A1 * | 11/2017 | Burchfield | E04H 15/001 |
| 2021/0332607 | A1 | 10/2021 | Goldszer et al. | |
| 2022/0136276 | A1 | 5/2022 | Furseth et al. | |
| 2022/0205270 | A1 | 6/2022 | Jerry et al. | |

OTHER PUBLICATIONS

Gazebo Store , "Easy Pop-Up Party Tent", available at https://www.thegazebostore.com/easy-pop-up-party-tent-13-x-13.html, exact publication date unknown, web page visited Jun. 18, 2020.

Habo Habo , "Tent with Hub—Six-Sided Tent with Accessories", available at https://www.aliexpress.com/i/4000340662867.html; exact publication date unknown, web page visited Dec. 7, 2020.

Houzz, "Outsunny 13' x 13' Adjustable Height Pop Up Canopy Party Tent with Easy Setup," URL: https://www.houzz.com/products/outsunny-13-x-13-adjustable-height-pop-up-canopy-party-tent-with-easy-setup-prvw-vr~87130317; web page visited Dec. 7, 2020.

Michigan Sportsman Forum, "Ground Blind Roof Collapse," URL: https://www.michigan-sportsman.com/forum/threads/ground-blind-roof-collapse.517897/; Sep. 2014; web page visited Dec. 7, 2020.

Pegasus Auto Racing Supplies , "EZ-UP Snap Button for Legs", Available at https://www.pegasusautoracing.com/productdetails.asp?RecID=4867, exact publication unknown, web page visited Sep. 12, 2020.

Clam Outdoors , "XL Thermal House, YouTube", URL: https://www.youtube.com/watch2v-tCOQJUOatnk, Nov. 10, 2019.

Clam Outdoors , "Yukon XL Thermal Ice Fishing Shelter", URL: https://shop.clamoutdoors.com/yukon-xl-thermal.html; web page visited Dec. 7, 2020.

Eskimo Fishing Gear , "Sled Style Shelters", URL: https://geteskimo.com/collections/sled; web page visited Dec. 11, 2020.

Helinox , "Outdoor Furniture", URL: https://helinox.com/pages/our-story; web page visited Dec. 11, 2020.

Ice Forts Custom Fish Houses , "XT Pro Lodge Shelter", URL: https://iceforts.com/product/xt-pro-lodge-shelter/; web page visited Dec. 11, 2020.

Kapsco Moto , "4 Bow Boat Bimini Top Cover", URL: https://www.sportsrecreationmall.com/product.jhtm?sku=kpscm3541&utm_medium=CPA&utm_campaign=commissionjunction&utm_source=affiliate&content=46157&cjevent=1d6458ad3bbd11eb823601670a1c0e0d; web page visited Dec. 7, 2020.

Mountains for Everyone , "What Is Freestanding Tent", URL: https://mountainsforeverybody.com/what-is-freestanding-tent-and-what-is-non-freestanding-tent; web page visited Dec. 11, 2020.

Rock West Composites , "Telescoping Clamps", URL: https://www.rockwestcomposites.com/shop/connector-accessories/locking-telescoping-mechanisms/telescoping-clamps, web page visited Dec. 16, 2020.

Taylor Made , "Bimini Support Poles", URL: https://www.taylormadeproducts.com/products/biminis/support-poles/, web page visited Dec. 7, 2020.

"U.S. Appl. No. 17/574,060", Nonfinal Office Action, dated Mar. 30, 2022, 16 pages.

* cited by examiner

PORTABLE SHELTERS

BACKGROUND

Conventional portable shelters, such as hub blinds for hunting, shelters for ice fishing, or tents for camping, may include a roof with a central hub and several flexible support poles extending from the central hub to support a covering material. Although such shelters are generally intended to be temporary, some users leave the shelters installed in place over extended periods of time and through multiple seasons. Conventional portable shelters tend to collapse when left out for extended periods of time. For example, wind may knock them over or snow may cause them to collapse.

SUMMARY

Representative embodiments of the present technology include shelters and frames for shelters that are sturdy and durable. A frame structure for a shelter includes a plurality of pole structures. In some embodiments, a pole structure includes telescopically movable pole portions and a spring-biasing mechanism configured to bias one pole portion away from the other, tending to extend the pole structure along its length. In some embodiments, a center hub structure of the portable shelter includes a locking mechanism for engaging one of the pole portions to interfere with telescopic movement of the pole structure. In some embodiments, a pole structure includes a flexible portion attached to a first rigid portion, and a second rigid portion that is movable relative to the first rigid portion. The second rigid portion is pivotable or telescopically movable between a first position in which the second rigid portion overlaps the first rigid portion such that the flexible portion is free to flex, and a second position in which the second rigid portion overlaps and restrains the flexible portion.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views:

FIG. 11A shows a side view of the pole structure. FIG. 11B shows a cross-section of the pole structure to illustrate its various components. FIG. 11C shows the pole structure in an exploded view to illustrate its various components.

DETAILED DESCRIPTION

The present technology is directed to shelters, frame structures for shelters, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, embodiments of the present technology may include additional elements or exclude some of the elements described below with reference to FIGS. 1-13, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Further, unless otherwise specified, terms such as "attached" or "connected" are intended to include integral connections, as well as connections between physically separate components.

Figure 1:
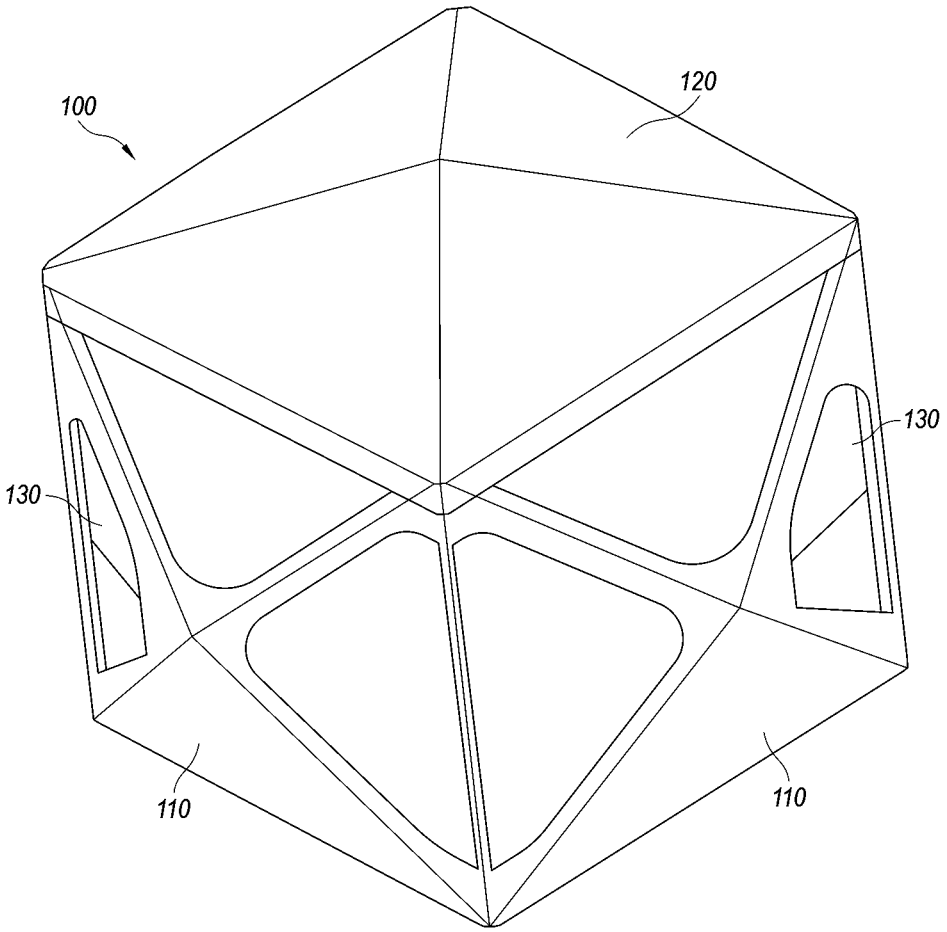
FIG. 1 illustrates a shelter configured in accordance with embodiments of the present technology.

FIG. 1 illustrates a shelter 100 configured in accordance with embodiments of the present technology. The shelter 100 may include a plurality of cover panels, such as side panels 110 and a roof 120. In some embodiments, the shelter 100 may include four side panels 110. In other embodiments, however, the shelter 100 may include three side panels 110, five side panels 110, or more side panels 110. One or more of the side panels 110 may include one or more windows 130, each of which may be in the form of an opening in a side panel 110, and which may be coverable with a cover or flap. One or more of the side panels 110 may include a large door opening. In some embodiments, one or more of the side panels may be omitted, for example, to form a shelter 100 with only a roof 120 or with a lesser number of side panels 110. Each of the side panels 110 and the roof 120 may include one or more sheets of a cover material, such as a fabric or plastic material, which is attached to, and supported by, a frame structure of the shelter 100, as explained regarding FIG. 2 below.

Figure 2:
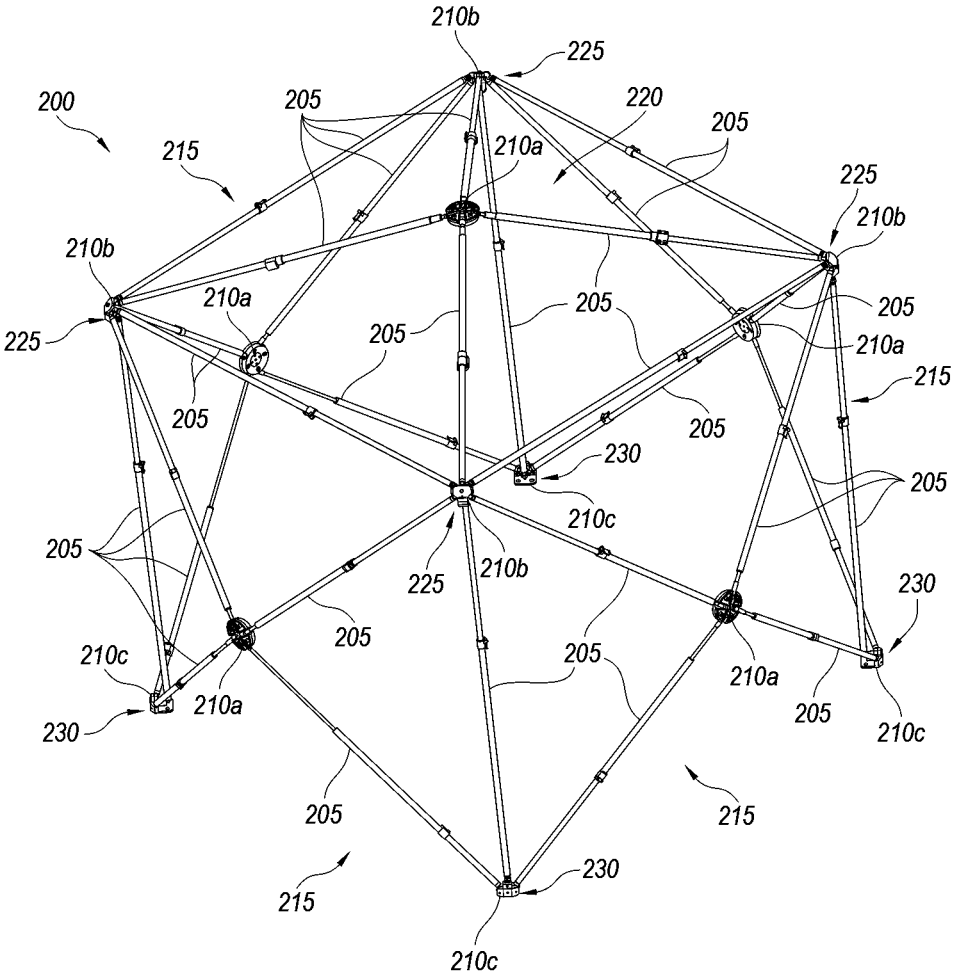
FIG. 2 illustrates a frame structure for a shelter, configured in accordance with embodiments of the present technology.

FIG. 2 illustrates a frame structure 200 for a shelter, configured in accordance with embodiments of the present technology. In some embodiments, the frame structure 200 may include a plurality of pole structures 205 interconnected with one or more hub structures 210*a*, 210*b*, 210*c*. The pole structures 205 may be removably attachable to the hub structures 210*a*, 210*b*, 210*c* or pivotable relative to the hub structures 210*a*, 210*b*, 210*c* for assembly and disassembly of the frame structure 200 (and the overall shelter).

The pole structures 205 may be extendable and retractable (for example, by telescoping or by flexing a flexible portion) to facilitate transformation of the frame structure 200 (and, correspondingly, the shelter) between a disassembled or stowed configuration and an assembled or deployed configuration (FIG. 2 illustrates the deployed configuration). The hub structures may include a center hub structure 210*a* for each side portion 215 of the frame structure 200 and for the roof portion 220 of the frame structure 200, upper corner hub structures 210*b* for one or more of the upper corners 225 of the frame structure 200, and lower corner hub structures 210*c* for one or more of the lower corners 230 of the frame structure 200. The frame structure 200 supports the sheets of cover material forming the side panels 110 and the roof 120 (see FIG. 1). The panels may be attached to the frame structure with fasteners, straps, or other suitable attachment devices.

Figure 3:
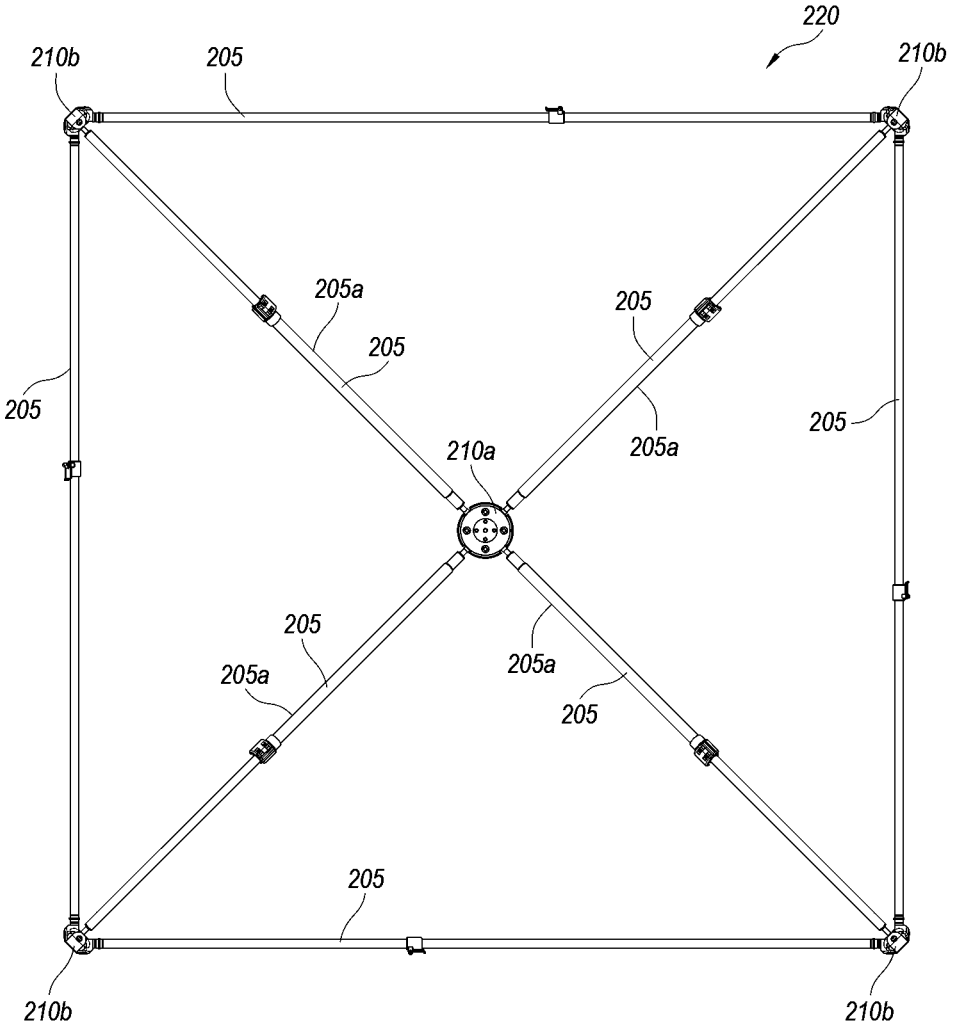
FIG. 3 illustrates a bottom view of a roof portion of a frame structure for a shelter in a deployed configuration, configured in accordance with embodiments of the present technology.

FIG. 3 illustrates a bottom view of the roof portion 220 of a frame structure for a shelter in a deployed configuration, configured in accordance with embodiments of the present technology. In contrast with conventional shelters, which typically include flexible roof poles, the roof-pole structures 205*a* attached to the roof center hub structure 210*a* are rigid when the frame structure is in the deployed configuration. As explained in further detail below, a roof-pole structure 205*a* may include a flexible portion that facilitates extension and retraction of the roof-pole structure 205*a* for manipulation during stowage and deployment, and the flexible portion may be selectively reinforceable with a reinforcement portion to maintain rigidity of the roof portion 220 when the frame structure is in the deployed configuration. In some embodiments, a roof-pole structure 205*a* may include a spring-biased telescoping mechanism. Pole structures 205 may extend between corner hub structures 210*b*.

Figure 4A:
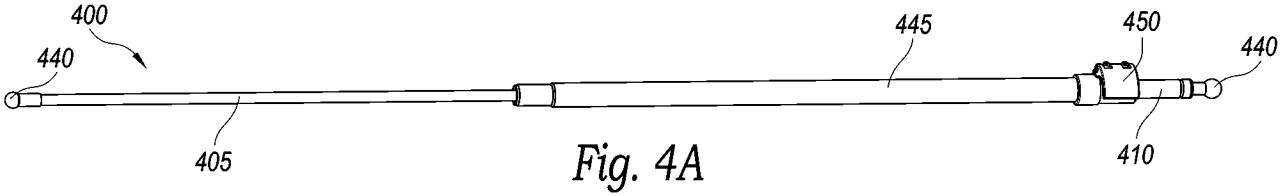
FIGS. 4A-4C illustrate a pole structure configured in accordance with an embodiment of the present technology, which is suitable for use as a roof-pole structure in frame structures and shelters.
Figure 4B:
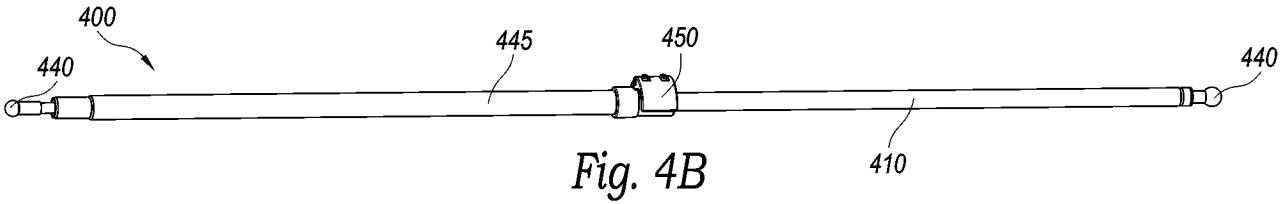
Figure 4C:
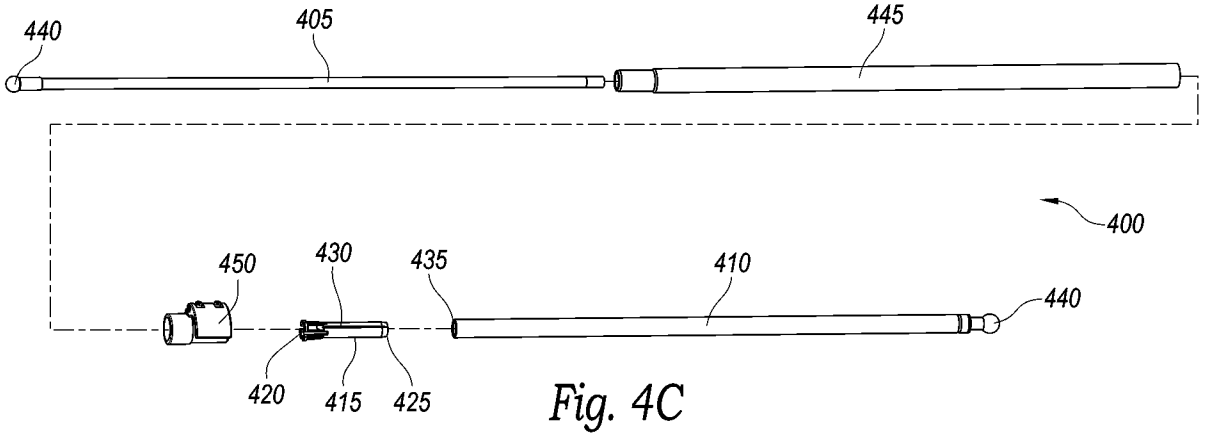

FIGS. 4A-4C illustrate a pole structure 400 configured in accordance with an embodiment of the present technology, which is suitable for use as a roof-pole structure 205*a* in frame structures and shelters according to embodiments of the present technology. FIG. 4A shows the pole structure 400 in a semi-rigid configuration suitable for facilitating stowage or deployment of a shelter. FIG. 4B shows the pole structure 400 in a rigid configuration suitable for use in a deployed shelter. FIG. 4C shows the pole structure 400 in an exploded view to illustrate its various components.

With reference to FIGS. 4A, 4B, and 4C, the pole structure 400 includes a flexible portion 405 attached to a first rigid portion 410. The flexible portion 405 may be parallel to, or coaxial with, the longitudinal axis of the first rigid portion 410. With specific reference to FIG. 4C, the flexible portion 405 may be attached to the first rigid portion 410 with a sleeve device 415. An open end 420 of the sleeve device 415 receives the flexible portion 405. The flexible portion 405 bottoms out on a closed end 425 of the sleeve device 415.

The sleeve device 415 optionally includes cutouts 430 extending along at least part of the length of the sleeve device 415. The cutouts 430 facilitate radial flexing of the sleeve device 415. When the flexible portion 405 is inserted in the sleeve device 415, and the sleeve device 415 is inserted in a first end 435 of the first rigid portion 410, the sleeve device 415 squeezes the flexible portion 405 to hold it in the sleeve device 415 via friction between the sleeve device 415 and the flexible portion 405. Further, friction between the sleeve device 415 and the first rigid portion 410 holds the flexible portion 405 and the sleeve device 415 in the first rigid portion 410. The closed end 425 of the sleeve device 415 prevents the flexible portion 405 from passing farther into the first rigid portion 410 than the sleeve device 415. In other embodiments, the flexible portion 405 may be attached to the first rigid portion 410 in other suitable manners.

The combination of the flexible portion 405 and the first rigid portion 410 results in a pole that is partially flexible and partially rigid. Each end of the pole structure 400 may include a connection element 440 for connecting to the center hub structures 210*a*, the upper corner hub structures 210*b*, or the lower hub structures 210*c* (see FIG. 2). In some embodiments, the connection element 440 may be a ball element that is receivable in a socket in a hub structure 210*a*, 210*b*, 210*c*.

When the pole structure 400 is installed in a frame structure, the flexible portion 405 facilitates deployment and adjustment of the frame structure and the shelter (because flexibility allows for manipulation and movement of the structure). However, flexible roof poles reduce overall rigidity of a shelter and may result in collapse, particularly in severe weather conditions. Accordingly, embodiments of the present technology include a movable reinforcement structure that may be positioned over or alongside the flexible portion 405 to rigidify the pole structure 400 and to improve the rigidity of the overall frame structure.

In some embodiments, the reinforcement structure may include a second rigid portion 445. The second rigid portion 445 and the first rigid portion 410 may be tubular structures that telescope relative to one another. With specific regard to FIGS. 4A and 4B, the second rigid portion 445 may be slidable from a first position—in which the second rigid portion 445 overlaps the first rigid portion 410 such that the flexible portion 405 is free to flex (FIG. 4A)—to a second position in which the second rigid portion 445 overlaps the flexible portion 405 and restrains the flexible portion 405 from flexing, such that an overall rigid pole structure 400 is formed (FIG. 4B).

In some embodiments, the pole structure 400 includes a locking mechanism 450 for selectively preventing relative movement between the first rigid portion 410 and the second rigid portion 445. The locking mechanism 450 may include a clamp or another suitable device for resisting (for example, preventing) the second rigid portion 445 from sliding relative to the first rigid portion 410 when the second rigid portion 445 is positioned at least partially (for example, fully) over the flexible portion 405. The locking mechanism 450 may be attached to the second rigid portion 445. In some embodiments, a locking mechanism 450 may include a spring-biased button element carried by the first rigid portion 410 and positioned to engage a hole or surface in the second rigid portion 445. In some embodiments, a locking mechanism 450 may include a bolt passing through one or both of the rigid portions 410, 445.

Figure 5:
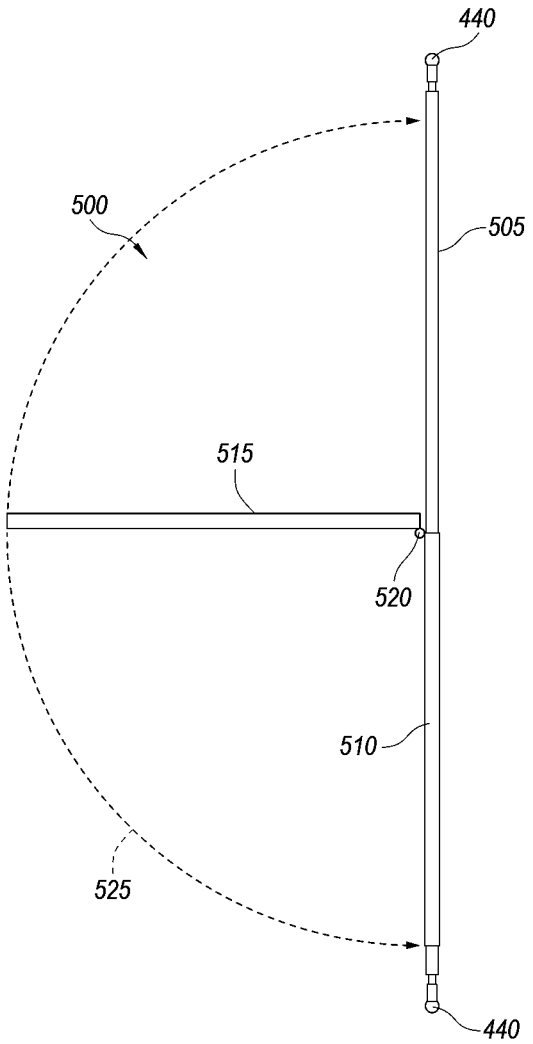
FIG. 5 illustrates a schematic view of a pole structure configured in accordance with an embodiment of the present technology.

FIG. 5 illustrates a schematic view of another pole structure 500 configured in accordance with an embodiment of the present technology. The pole structure 500 is suitable for use as a roof-pole structure 205*a* in frame structures and shelters according to embodiments of the present technology. The pole structure 500 is similar to the pole structure 400 described with regard to FIGS. 4A-4C but, in this embodiment, the pole structure 500 includes a movable reinforcement structure (for example, the second rigid portion 515 described below) that pivots about a hinge, as opposed to telescoping like the movable reinforcement structure described with regard to FIGS. 4A-4C.

The pole structure 500 includes a flexible portion 505 attached to a first rigid portion 510. The flexible portion 505 may be attached to the first rigid portion 510 in a manner similar to that in which the flexible portion 405 may be attached to the first rigid portion 410 of the pole structure 400 described with regard to FIGS. 4A-4C (for example, using a sleeve device 415 or another suitable manner of attachment). Accordingly, the combination of the flexible portion 505 and the first rigid portion 510 results in a pole that is partially flexible and partially rigid. Each end of the pole structure 500 may include a connection element 440 for connecting to the various hub structures, as described above.

When the pole structure 500 is installed in a frame structure, the flexible portion 505 facilitates deployment and adjustment of the frame structure and the shelter. The pole structure 500 may include a movable reinforcement structure in the form of a second rigid portion 515 that pivots about a hinge 520 along a rotational pathway 525 to align with or overlap (for example, cover) the flexible portion 505 to form an overall rigid pole structure 500 that improves rigidity of the overall frame structure. In some embodiments, the second rigid portion 515 may rotate to a position adjacent to and aligned with the first rigid portion 510 to keep it out of the way when a user is stowing or deploying a frame structure. In some embodiments, the second rigid portion 515 may be a tube, a bar, or another suitable rigid elongated element. In some embodiments, the pole structure 500 may include one or more locking mechanisms to hold the second rigid portion 515 adjacent to or alongside one or both of the flexible portion 505 or the first rigid portion 510. A locking mechanism may include a clamp or another suitable fastening device.

In general, pole structures configured in accordance with embodiments of the present technology may include a flexible portion (such as the flexible portions 405, 505 described above) attached to a first rigid portion (such as the first rigid portions 410, 510 described above), and a second rigid portion (such as the second rigid portions 445, 515 described above) that is selectively movable relative to the first rigid portion. Such pole structures are adjustable between a first configuration in which the pole structure is flexible or collapsible for facilitating manipulation of a frame structure during stowage or deployment of the frame structure (due to the flexible portion being generally free to flex), and a second configuration in which the pole structure is generally rigid and exerts tension on one or more panels attached to the frame structure (due to the second rigid portion restraining the flexible portion or carrying the structural load in place of the flexible portion).

Figure 6:
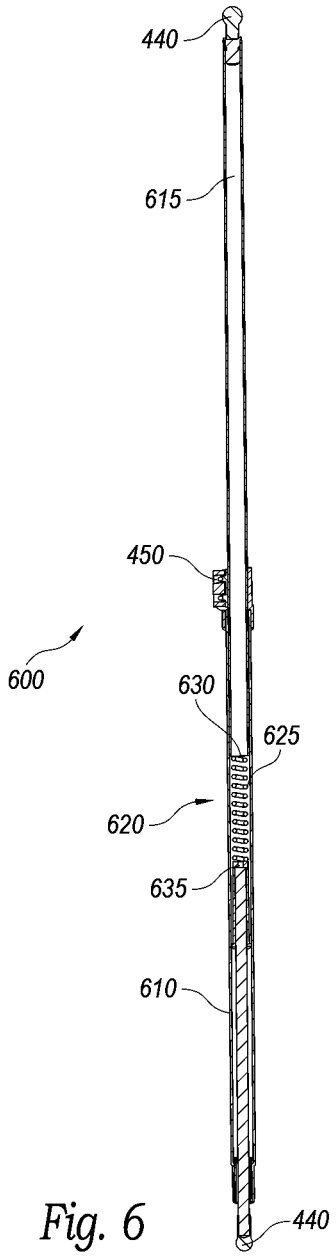
FIG. 6 illustrates a partially schematic cross-sectional view of a pole structure configured in accordance with embodiments of the present technology.

FIG. 6 illustrates a partially schematic cross-sectional view of another pole structure 600 configured in accordance with embodiments of the present technology. The pole structure 600 is suitable for use as a roof-pole structure 205*a* in frame structures and shelters configured according to embodiments of the present technology. Rather than including a flexible portion like the pole structures 400, 500 described above, in some embodiments, the pole structure 600 may be formed with portions that are generally rigid. For example, a first rigid portion 610 and a second rigid portion 615 may be telescopically arranged such that the second rigid portion 615 is telescopically movable into and out of the first rigid portion 610. Such a telescopic arrangement facilitates deployment and adjustment of a frame structure and a shelter.

The pole structure 600 may further include a locking mechanism 450 for selectively preventing relative movement between the first rigid portion 610 and the second rigid portion 615. The locking mechanism 450 may be similar to the locking mechanism 450 described above with regard to FIGS. 4A-4C. For example, the locking mechanism 450 may include a clamp or other suitable device for resisting (for example, preventing) the second rigid portion 615 from sliding relative to the first rigid portion 610 when the second rigid portion 615 is extended from the first rigid portion 610. The locking mechanism 450 may be attached to the first rigid portion 610. Each end of the pole structure 600 may include a connection element 440 for connecting to the various hub structures, as described above.

In some embodiments, the pole structure 600 may include a spring-biasing mechanism 620 for biasing the second rigid portion 615 away from the first rigid portion 610 to extend the pole structure 600 toward a maximum length. In some embodiments, a spring-biasing mechanism 620 may include a compression spring 625 positioned inside the first rigid portion 610 between an end 630 of the second rigid portion 615 (specifically, the end 630 opposite the end that has the connection element 440) and a stop element 635. The stop element 635 may be fixed inside the first rigid portion 610 at a location that allows the second rigid portion 615 to move a sufficient amount while allowing the spring 625 to compress and extend to push on the second rigid portion 615.

In operation, when the locking mechanism 450 is unlocked, the pole structure 600 is extendable and retractable (with a bias toward the extended position due to the spring-biasing mechanism 620) to facilitate stowage or deployment of a frame structure for a shelter. The spring-biasing mechanism 620 provides tension to the frame structure and the panels to tighten the panels. When the user is satisfied with the tension in the frame structure and the panels, the user may lock the locking mechanism 450 to prevent the roof portion from collapsing.

Figure 7A:
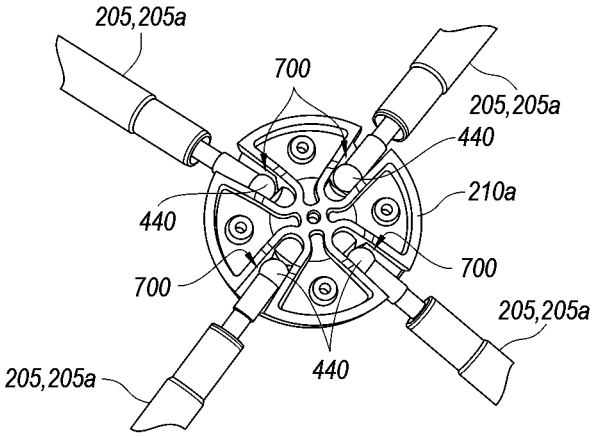
FIGS. 7A and 7B illustrate a detailed top perspective view and a detailed bottom perspective view, respectively, of a center hub structure connecting four pole structures (for example, four roof-pole structures).
Figure 7B:
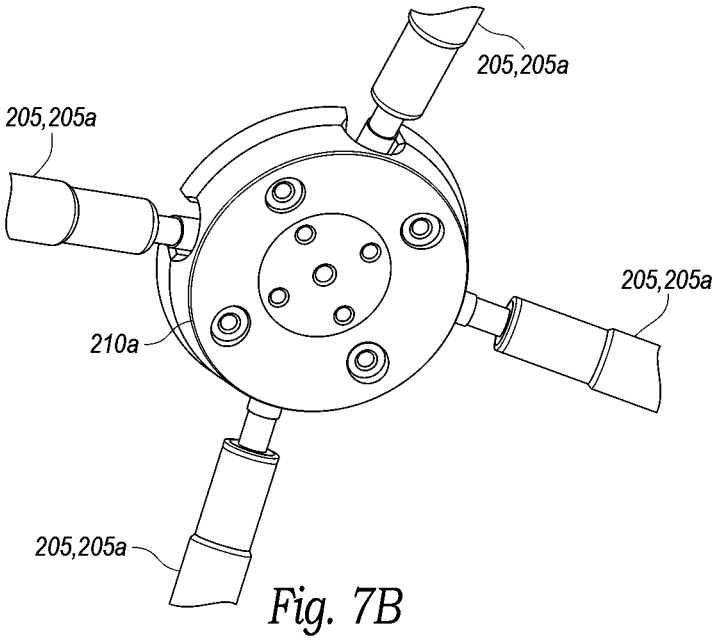

FIGS. 7A and 7B illustrate detailed views of a top perspective view and a bottom perspective view, respectively, of a center hub structure 210*a* connecting four pole structures 205 (for example, four roof-pole structures 205*a*). The center hub structure 210*a* may include sockets 700 for receiving the connection elements 440 to form a secure and pivotable connection among the pole structures 205, 205*a*. Although ball and socket connections between the connection elements 440 and the center hub structure 210*a* are illustrated and described, other embodiments may include other suitable connection mechanisms.

Figure 8A:
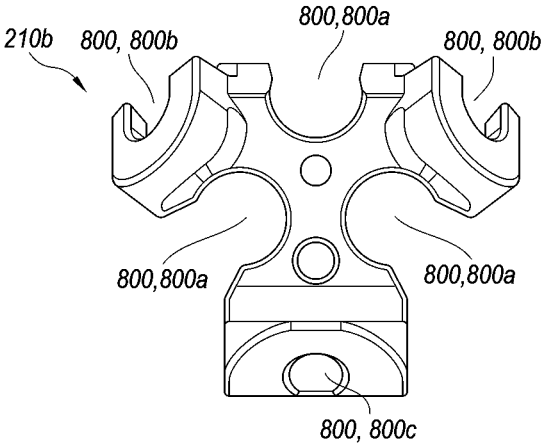
FIG. 8A illustrates a front view (from an interior of a frame structure) of an upper corner hub structure configured in accordance with an embodiment of the present technology.
Figure 8B:
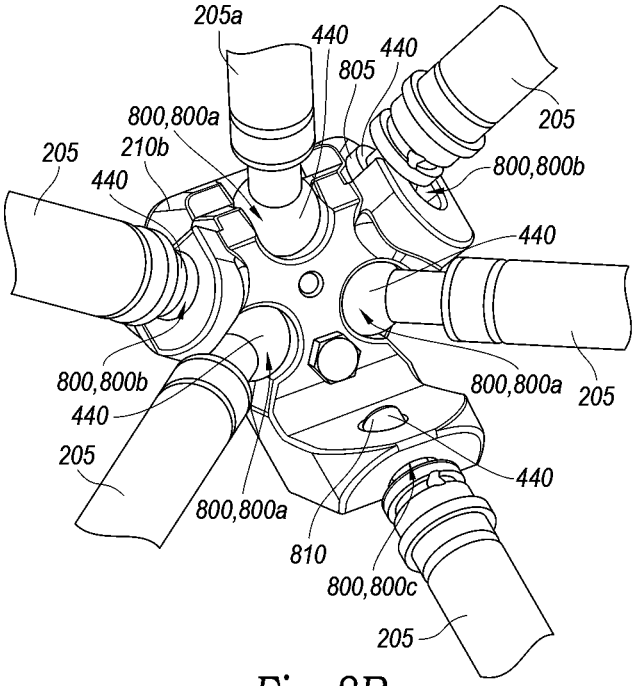
FIG. 8B illustrates a front view (from an interior of a frame structure) of the upper corner hub structure shown in FIG. 8A connected to a plurality of pole structures.

FIG. 8A illustrates a front view (from an interior of a frame structure) of an upper corner hub structure 210*b* configured in accordance with an embodiment of the present technology. FIG. 8B illustrates a front view (from an interior of a frame structure) of the upper corner hub structure 210*b* shown in FIG. 8A connected to a plurality of pole structures 205, 205*a*. With reference to FIGS. 8A and 8B, the upper corner hub structure 210*b* may include a plurality of sockets 800 for receiving connection elements 440 of pole structures 205. For example, the upper hub structure 210*b* may include one or more (such as three) ball sockets 800*a* for receiving connection elements 440 that include ball elements.

In some embodiments, one or more connection elements 440 may be in the form of a disk element 805 carried by an end of the pole structure 205, and the disk element 805 may be held in a corresponding socket 800*b* in the form of a slot. In some embodiments, one or more connection elements 440 may be in the form of a pin element 810, and the pin element 810 may be held in a corresponding socket 800*c* in the form of a cylindrical recess.

With additional reference to FIGS. 2 and 3, each upper hub structure 210*b* connects several pole structures 205 to form side portions 215 and the roof portion 220 of the frame structure 200. The upper corner hub structure 210*b* facilitates flex and movement of the components of the frame to facilitate installation and to accommodate wind or environmental conditions while resisting collapse of the structure. Horizontal pole structures 205 spanning between the upper corner hub structures 210*b* may be referred to as spanner poles, which provide both tension and compression forces to support the overall frame structure and to keep the panels taut. Vertical pole structures 205 spanning between the upper corner hub structures 210*b* and the lower corner hub structures 210*c* may also provide both tension and compression forces to support the overall frame structure and to keep the panels taut.

Figure 9:
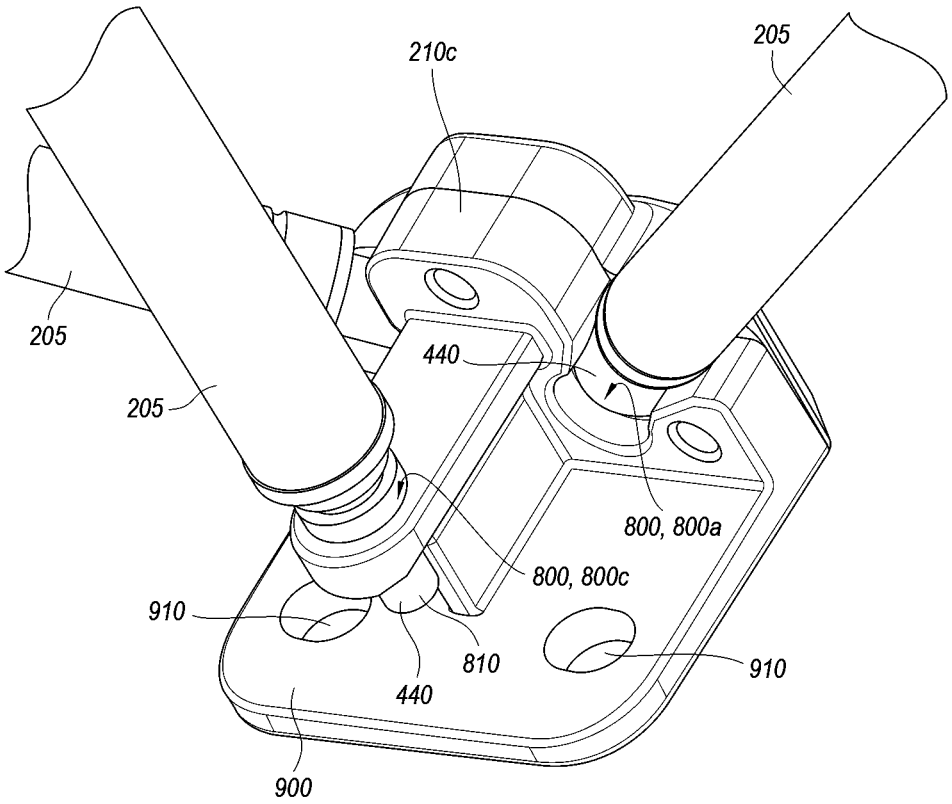
FIG. 9 illustrates a perspective view of a lower corner hub structure configured in accordance with an embodiment of the present technology.

FIG. 9 illustrates a perspective view of a lower corner hub structure 210*c*, configured in accordance with an embodiment of the present technology. In some embodiments, the lower corner hub structure 210*c* may be similar to the upper corner hub structures 210*b* but may accommodate more or fewer pole structures 205. In some embodiments, a lower corner hub structure 210*c* may include a base portion 900 for supporting the frame structure on the ground or other surface. In some embodiments, the base portion 900 may include holes 910 for receiving a stake or bolt to attach the lower corner hub structure 210*c* (and the overall frame structure) to the ground or another surface.

Figure 10:
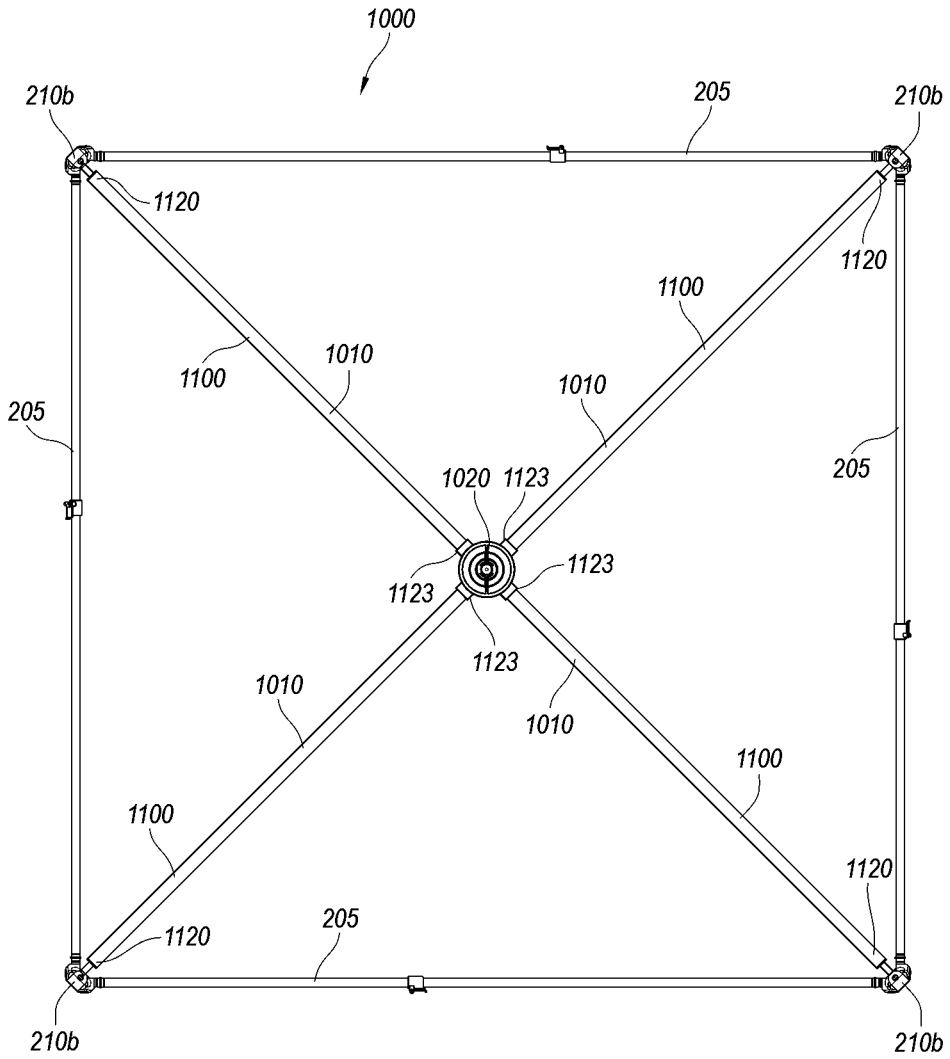
FIG. 10 illustrates a bottom view of a roof portion of a frame structure for a shelter in a deployed configuration, configured in accordance with further embodiments of the present technology.

FIG. 10 illustrates a bottom view of a roof portion 1000 of a frame structure for a shelter in a deployed configuration, configured in accordance with further embodiments of the present technology. The roof portion 1000 may be implemented in the frame structure 200 described above with regard to FIG. 2. The roof portion 1000 shown in FIG. 10 includes pole structures 1010 configured in accordance with further embodiments of the present technology, spanning between the upper corner hub structures 210*b* and a center hub structure 1020.

As explained in detail below, a pole structure 1010 (which may be implemented as a roof-pole structure) may include pole portions that are spring-biased relative to one another. The spring-biased structure facilitates extension and retraction of the pole structure 1010 along its length for manipulation during stowage and deployment of the frame structure and the shelter. As explained in detail below, the center hub structure 1020 may include a locking mechanism configured to rigidify the roof portion 1000. Although a roof portion 1000 is described, embodiments of the present technology may be implemented in a side portion or other portion of a frame structure for a shelter.

Figure 11A:
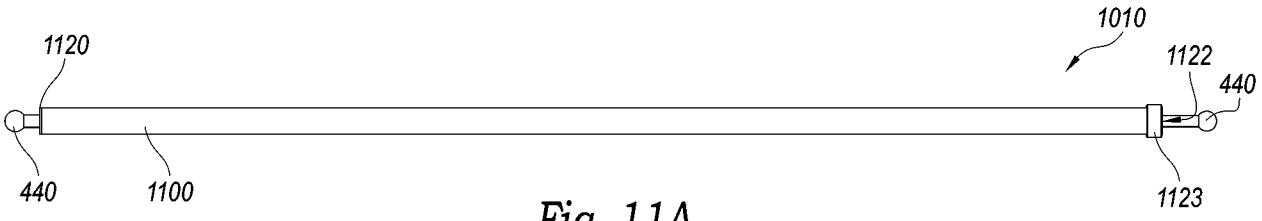
FIGS. 11A-11C illustrate a pole structure shown in FIG. 10.
Figure 11B:
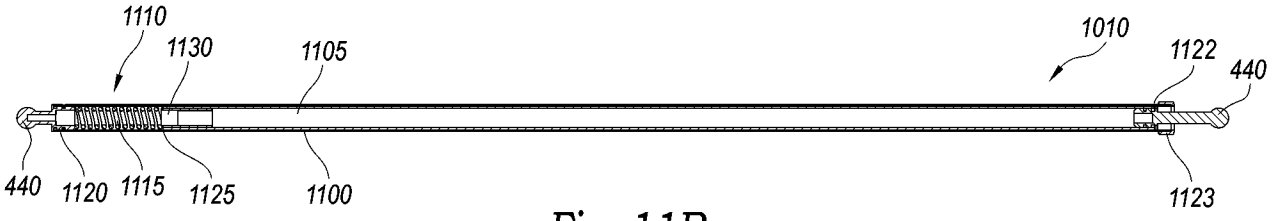
Figure 11C:
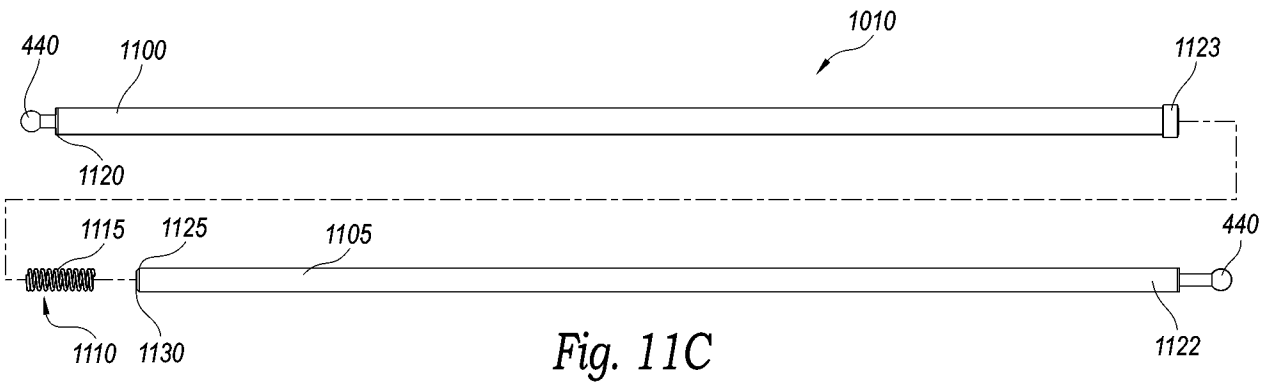

FIGS. 11A-11C illustrate the pole structure 1010 shown in FIG. 10. FIG. 11A shows a side view of the pole structure 1010. FIG. 11B shows a cross-section of the pole structure 1010 to illustrate its various components. FIG. 11C shows the pole structure 1010 in an exploded view to illustrate its various components.

With reference to FIGS. 10, 11A, 11B, and 11C, the pole structure 1010 may include a first pole portion 1100 and a second pole portion 1105. The first pole portion 1100 and the second pole portion 1105 may be arranged such that the second pole portion 1105 is movable relative to or within the first pole portion 1100. For example, the first pole portion 1100 and the second pole portion 1105 may be telescopically arranged such that the second pole portion 1105 is telescopically moveable relative to the first pole portion 1100. Such a telescopic arrangement facilitates deployment of a frame structure and shelter, as explained below.

The first pole portion 1100 may extend from a first end 1120 to a second end 1123 positioned opposite the first end 1120. The second pole portion 1105 may extend from a first end 1125 to a second end 1122 opposite the first end 1125. Each end of the pole structure 1010 may include a connection element 440 for connecting to the various hub structures disclosed herein. For example, the first end 1120 of the first pole portion 1100 may include a connection element 440, and the second end 1122 of the second pole portion 1105 may include a connection element 440.

In some embodiments, the pole structure 1010 includes a biasing mechanism 1110 for biasing the second pole portion 1105 away from the first pole portion 1100, tending to extend the pole structure 1010 along its length. In some embodiments, the biasing mechanism 1110 may be a spring-biasing mechanism, and it may include a compression spring 1115 positioned inside the first pole portion 1100 between the first end 1120 of the first pole portion 1100 and the first end 1125 of the second pole portion 1105 (the first end 1125 of the second pole portion 1105 may be positioned inside the first pole portion 1100).

In some embodiments, a plug element 1130 may be positioned in the first end 1125 of the second pole portion 1105 to rigidly receive or otherwise press against the biasing mechanism 1110 (for example, to transmit force from the biasing mechanism 1110 to the second pole portion 1105). In some embodiments, one or both of the pole portions 1100, 1105 may be rigid or generally rigid, or they may have other levels of stiffness sufficient to support the weight of roof panels or debris on the roof of a structure. Generally, the pole structure 1010 may include a structure that is collapsible along its axis, which may optionally be spring-biased to extend the structure along its length.

Figure 12A:
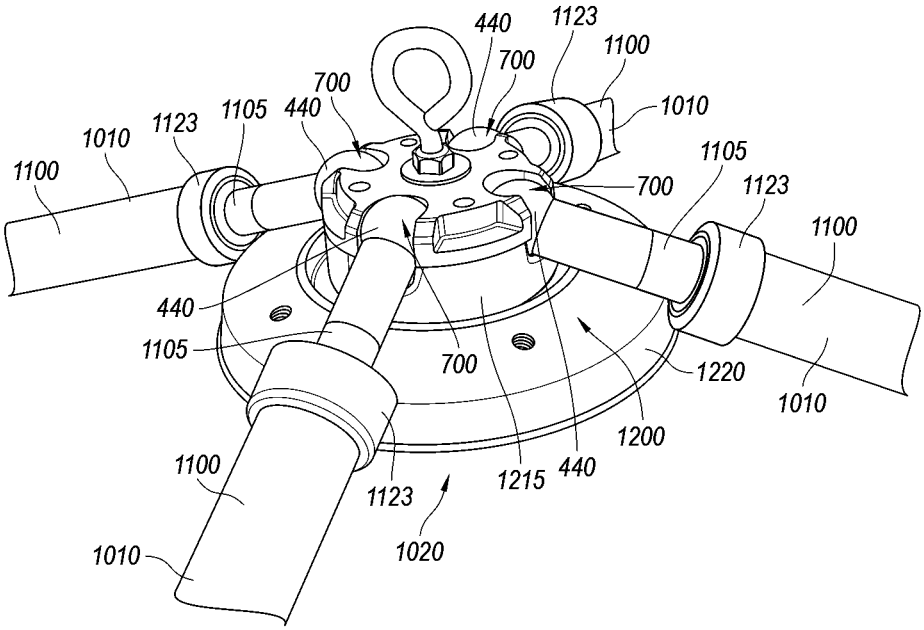
FIG. 12A illustrates a perspective view of a center hub structure shown in FIG. 10, with four pole structures installed therein.
Figure 12B:
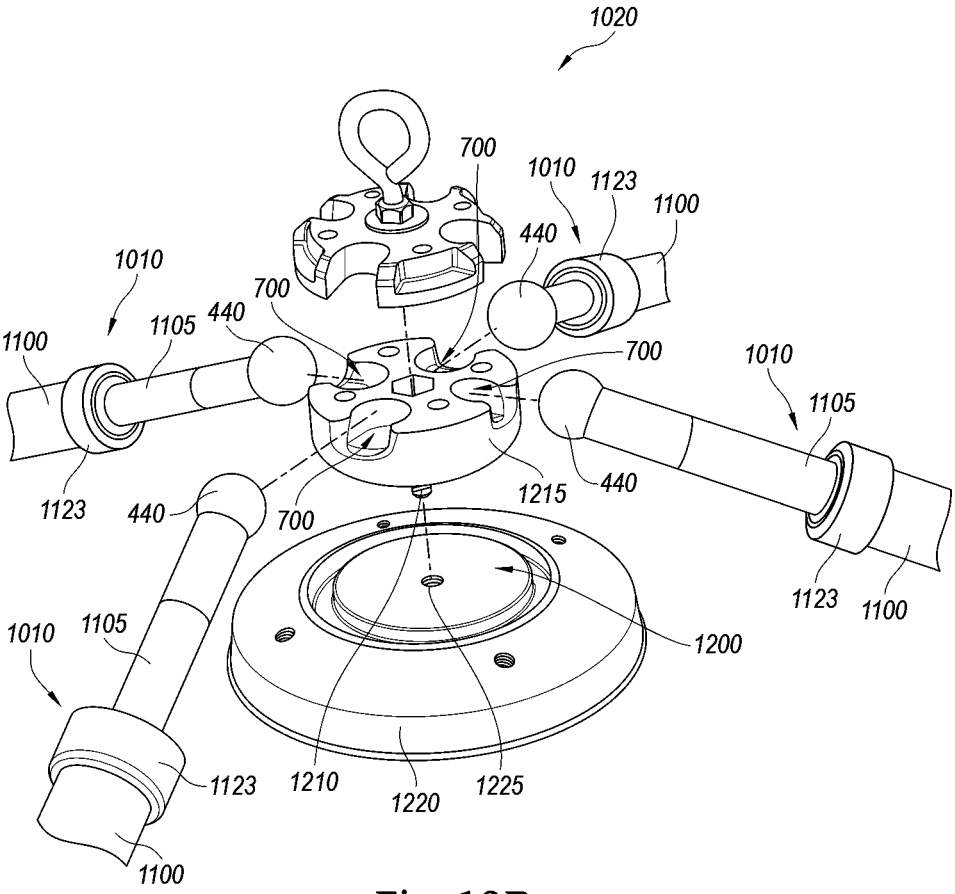
FIG. 12B illustrates an exploded perspective view of the structure shown in FIG. 12A.

FIG. 12A illustrates a perspective view of the center hub structure 1020 shown in FIG. 10, connected to four pole structures 1010. FIG. 12B illustrates an exploded perspective view of the assembly shown in FIG. 12A. With reference to FIGS. 12A and 12B, the center hub structure 1020 may include a hub body 1215, which may be generally similar to the center hub structure 210*a* shown in FIG. 2 (for example, it may include sockets 700 for receiving the connection elements 440 to form a secure and pivotable connection among the pole structures 1010).

The center hub structure 1020 may further include a locking mechanism 1200 configured to rigidify the roof portion 1000. For example, the locking mechanism 1200 may include a plate element 1220 connected to the hub body

1215 and positioned to move relative to the hub body 1215. In some embodiments, the locking mechanism 1200 may include a threaded shaft 1210 carried by the hub body 1215 for engaging a threaded bore 1225 in the plate element 1220. In some embodiments, the plate element 1220 may include the threaded shaft, and the hub body 1215 may include the threaded bore. In other embodiments, the plate element 1220 may be carried by or movably attached to the hub body 1215 in other ways. In some embodiments, the plate element 1220 includes a circular or round disk element. In other embodiments, the plate element 1220 may have other suitable shapes.

The locking mechanism 1200 (for example, the plate element 1220) is positionable to interfere with the second ends 1123 of the first pole portions 1100. For example, the plate element 1220 is positionable to abut the second ends 1123 of each of the first pole portions 1100 (see FIG. 10).

With reference to FIGS. 10-12B, in operation, when assembling a frame structure configured in accordance with embodiments of the present technology, a user may position the connection elements 440 in corresponding upper corner hub structures 210*b* and in the center hub structure 1020 (for example, in corresponding sockets 700, 800; see also FIGS. 8A-8B). In position, the pole structures 1010 may span between the upper corner hub structures 210*b* and the center hub structure 1020. In some embodiments, a frame structure may include the pole structures 1010 already connected to the center hub structure 1020 and the upper corner hub structures 210*b*.

For convenience, a user may install the pole structures 1010 when the center hub structure 1020 is at a relatively low position relative to the remainder of the roof portion 1000. In this position, the roof portion 1000 may have a generally concave, upwardly opening shape. A user may then push the center hub structure 1020 upward. As the center hub structure 1020 moves upward, the pole structures 1010 collapse telescopically (due to geometric constraints) until the center hub structure 1020 is approximately level with the remainder of the roof portion 1000.

As the user continues to push the center hub structure 1020 upward, the roof portion 1000 may pop upwardly due to the force from the biasing mechanism 1110 tending to bias the pole structures 1010 toward their extended lengths. The center hub structure 1020 is then positioned higher than the remainder of the roof portion 1000, forming a generally convex roof shape pointing upward. At that point, the biasing mechanism 1110 may temporarily support the weight of the roof, although the roof portion 1000 may flex due to the axial flexure allowed by the telescoping nature of the pole structures 1010. In some embodiments, a biasing mechanism 1110 may be omitted and a user may simply push and hold the center hub structure 1020 upward without spring assistance.

The locking mechanism 1200 may rigidify the roof portion 1000. As generally illustrated in FIG. 12A, for example, the locking mechanism 1200 may be positioned to abut or otherwise interfere with the second ends 1123 of each of the first pole portions 1100, which results in the first pole portion forming an axially rigid connection between the center hub structure 1020 and the corner of the frame structure.

Specifically, and with reference to FIGS. 10 and 12A, the first end 1120 of the first pole portion 1100 is connected to a corner region of the shelter, the second pole portion 1105 is connected to the hub body 1215, and the plate element 1220 is movable between a first position and a second position. In the first position, the plate element 1220 does not interfere with telescoping motion of the pole structures 1010 (such that movement of the center hub structure 1020 causes the second pole portion 1105 to move relative to the first pole portion 1100). In the second position, the plate element 1220 abuts the second ends 1123 of the first pole portions 1100 and interferes with movement of the second pole portions 1105 relative to the first pole portions 1100.

The plate element 1220 may be movable between the first and second positions by threading it toward and away from the hub body 1215, or by removing it from the hub body 1215 and replacing it on the hub body 1215. With the plate element 1220 threaded in the second position, the plate element 1220 presses against the second ends 1123 of the first pole portions 1100, and compressive force is transferred through the first pole portions 1100 to the upper corner hub structures 210*b*. Accordingly, when the shelter is deployed, the plate element 1220 may be positioned in the second position to provide a rigid roof portion.

In other words, the locking mechanism 1200 generally causes compressive forces (from the weight of the roof onto the center hub structure 1020) to bypass the second pole portions 1105 and the biasing mechanisms 1110, and instead to primarily (or entirely) pass through the first pole portions 1100. Accordingly, when the locking mechanism 1200 is engaged (when the plate element 1220 is in the second position, pressing against the second ends 1123 of the first pole portions 1100), the locking mechanism 1200 reduces or prevents relative movement between the first pole portions 1100 and the second pole portions 1105, which rigidifies the roof portion 1000.

Figure 13:
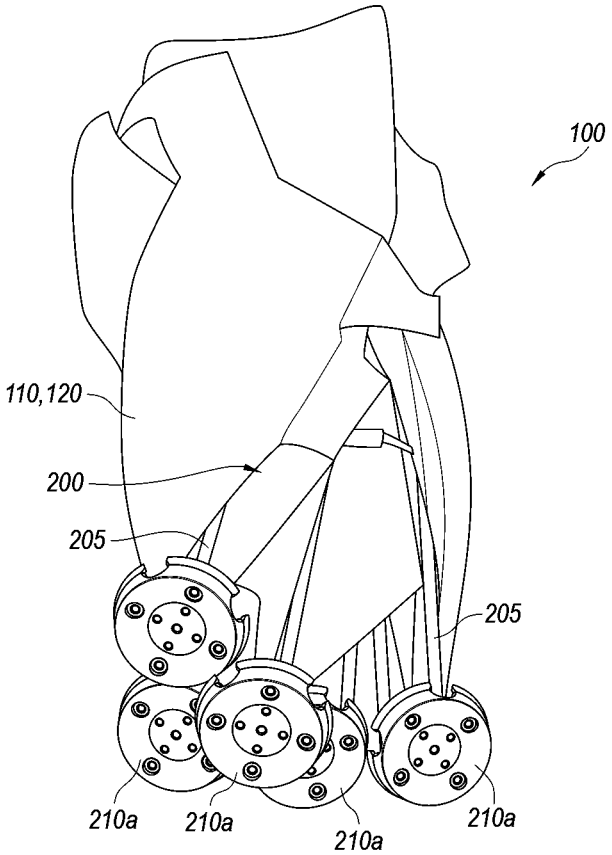
FIG. 13 illustrates a perspective view of a shelter configured in accordance with embodiments of the present technology, in a collapsed or stowed configuration.

FIG. 13 illustrates a perspective view of a shelter 100 configured in accordance with embodiments of the present technology in a stowed configuration in which the frame structure 200 and the overall shelter 100 are generally collapsed. In this configuration, the panels 110, 120 are folded around the frame structure 200. The frame structure 200 and the shelter 100 are movable to the deployed configuration shown in FIGS. 1 and 2, in which the frame structure and the overall shelter are generally expanded.

In use, frame structures and shelters configured in accordance with embodiments of the present technology may be deployed in any suitable manner, while utilizing the pole structures described herein. For example, frame structures and shelters may be configured to "pop-up" or deploy quickly, after which a user may position the reinforcement portions over (or alongside) the flexible portions to rigidify portions of the frame structure (as explained above regarding FIGS. 4A-5). In other embodiments, as explained above with regard to FIG. 6, a user may employ a spring-biased telescoping pole structure 600 to rigidify a portion of the frame structure. In yet further embodiments, as explained above regarding FIGS. 10-12B, a user may employ a locking mechanism to cause compressive forces to generally bypass a telescoping mechanism and to generally send compressive forces directly from a center hub to a corner hub.

In some embodiments, only the roof portion of a frame structure employs pole structures 400, 500, 600, 1010 as described above. In other embodiments, pole structures 400, 500, 600, 1010 may be employed in any portion of a frame structure, such as one or more sides of a frame structure. Accordingly, any of the pole structures 205 implemented in a frame structure may be a pole structure 400, 500, 600, 1010 described above with regard to FIGS. 4A, 4B, 4C, 5, 6, and 11A-11C. In some embodiments, the flexible portions 405, 505 (see FIGS. 4 and 5) or the second rigid portion 615 (see FIG. 6) may be positioned closer to a center hub structure (210*a*, see FIG. 2) than to a corner hub structure (210*b*, 210*c*). In other embodiments, the flexible portions 405, 505 or the second rigid portion 615 may be positioned closer to a corner hub structure than to a center hub structure. The pole structures 400, 500, 600, 1010 configured in accordance with embodiments of the present technology include a first configuration in which the pole structure is flexible or collapsible for facilitating manipulation of the frame structure during stowage or deployment of the frame structure, and a second configuration in which the pole structure is generally rigid and exerts tension on one or more of the cover panels.

In some embodiments, a shelter may include a single stand-alone wall or a single roof structure configured to be supported by a suitable support structure. For example, individual side portions 215 and roof portions 220, 1000 (each of which may include a plurality of pole structures and hubs to form a frame, with one or more panels of material attached thereto) may be implemented independently in various embodiments and oriented in any suitable manner to provide a shelter. A shelter configured in accordance with embodiments of the present technology need not include multiple sides supporting a roof. In some embodiments, a shelter may be an umbrella or an indoor or outdoor partition structure (such as a partition or shade from the sun or wind in an outdoor environment). In some embodiments, a shelter may be in the form of a single wall or partition structure configured to be supported by a corner or an edge of the single wall. In other words, a roof or side structure implementing aspects of the present technology (such as the hub structures and pole structures) may be deployed independently of other walls or supports associated with a shelter. In some embodiments, therefore, a shelter may include a hub structure, one or more pole structures, and one or more panels of cover material attached to or supported by the hub structure and the pole structures. The rigidity provided by embodiments of the present technology is advantageous in providing a deployable wall or partition that can be supported on a single side or corner.

Various suitable materials may be used to form the various components of the frame structure and the panels. Rigid or generally rigid components such as the hub structures, connection elements, or rigid portions of pole structures may include composite materials such as high-stiffness fiberglass or carbon fiber, high-stiffness plastic materials, or metal materials. Flexible portions of pole structures may include flexible composite materials such as low-stiffness fiberglass or carbon fiber, flexible plastic materials, elastomeric materials, or other materials suitable for making the flexible portions of the pole structures flexible and resilient.

Some embodiments of the present technology include kits of parts for assembling a frame structure or shelter. Kits of parts may include some or all of any of the elements of a frame structure or shelter described herein. For example, a kit of parts may include a plurality of pole structures 205, 400, 500, 600, 1010, a plurality of hub structures 210*a*, 210*b*, 210*c*, 1020, a plurality of panels 110, 120, or other components or combinations of components disclosed herein.

Embodiments of the present technology include portable shelters (such as hub blinds, ice shacks, work shelters, tents, partitions, or umbrellas) that resist collapse, even when left installed for extended periods of time and in inclement conditions. Pole structures 400, 500, 600, 1010 configured in accordance with embodiments of the present technology enable a user to stiffen the roof or sides of a portable shelter and to apply and maintain tension on the panels used in the roof or sides of a portable shelter. Any suitable number of pole structures may be used in various embodiments.

From the foregoing, it will be appreciated that specific embodiments of the presently disclosed technology have been described herein for purposes of illustration, but that various modifications may be made without deviating from the scope of the technology. For example, although shelters are illustrated herein as including four walls, some embodiments may include more or fewer walls (such as three walls, five walls, or more walls). Although shelters are illustrated as having sheets of material forming walls of the shelters, in some embodiments, one or more sheets of material may be eliminated to form openings in one or more walls or the roof of the shelter. In some embodiments, sheets of material may be omitted entirely (such that some embodiments of the technology include frame structures without walls or a roof). Although corner hub structures 210*b*, 210*c* may be implemented in various embodiments, in some embodiments, pole structures may be held in sleeves or pockets attached to or integral with the material forming one or more of the panels 110, 120. In some embodiments, a vertical support pole may be positioned between the roof hub structure 210*a* and the ground to provide additional support for the roof.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A shelter comprising a frame structure, the frame structure comprising a plurality of pole structures and at least one hub structure, wherein the hub structure connects two or more of the pole structures, wherein each pole structure of the plurality of pole structures comprises:
   - a first rigid portion;
   - a flexible portion attached to the first rigid portion;
   - a connection element directly attached to an end of the flexible portion, wherein the connection element comprises a ball element, and wherein the connection element is connected to the hub structure; and
   - a second rigid portion that is movable relative to the first rigid portion between a first position in which the second rigid portion overlaps the first rigid portion such that the flexible portion is free to flex, and a second position in which the second rigid portion overlaps the flexible portion and restrains the flexible portion.

2. The shelter of claim 1, wherein the second rigid portion is telescopically movable relative to the first rigid portion between the first and second positions.

3. The shelter of claim 1, wherein the second rigid portion is pivotably movable relative to the first rigid portion between the first and second positions.

4. The shelter of claim 1, wherein the at least one hub structure comprises a socket for receiving the ball element.

5. The shelter of claim 1, wherein each pole structure comprises a locking mechanism configured to selectively prevent relative movement between the first rigid portion and the second rigid portion.

6. The shelter of claim 5, wherein the locking mechanism comprises a clamp.

7. The shelter of claim 1, further comprising a plurality of panels attached to the frame structure.

8. The shelter of claim 1, wherein the flexible portion is attached to the first rigid portion with a sleeve device, wherein the sleeve device holds the flexible portion and the first rigid portion holds the sleeve device.

9. A shelter comprising a frame structure, the frame structure comprising a plurality of pole structures and at least one hub structure, wherein the hub structure connects two or more of the pole structures, wherein each pole structure of the plurality of pole structures comprises:

a first rigid portion;

a flexible portion attached to the first rigid portion and extending toward the hub structure along a majority of a distance from the first rigid portion to the hub structure; and a second rigid portion that is movable relative to the first rigid portion between a first position in which the second rigid portion overlaps the first rigid portion such that the flexible portion is free to flex, and a second position in which the second rigid portion overlaps the flexible portion and restrains the flexible portion.

10. The shelter of claim 9, wherein the second rigid portion is telescopically movable relative to the first rigid portion between the first and second positions.

11. The shelter of claim 9, wherein the second rigid portion is pivotably movable relative to the first rigid portion between the first and second positions.

12. The shelter of claim 9, wherein each pole structure comprises a locking mechanism configured to selectively prevent relative movement between the first rigid portion and the second rigid portion.

* * * * *